United States Patent [19]

Barakitis et al.

[11] 4,329,621

[45] May 11, 1982

[54] STARTER AND DISCHARGE LAMP STARTING CIRCUIT

[75] Inventors: Nikolaos Barakitis, Haverhill; Sheppard Cohen, Danvers, both of Mass.

[73] Assignee: GTE Products Corporation, Stamford, Conn.

[21] Appl. No.: 216,874

[22] Filed: Dec. 15, 1980

[51] Int. Cl.[3] ..... H01J 7/44; H01J 17/34; H01J 19/78; H01J 29/96

[52] U.S. Cl. ..... 315/47; 313/146; 313/151; 315/72; 315/73; 315/74; 315/106; 315/125; 315/DIG. 7

[58] Field of Search ..... 315/45, 46, 47, 100, 315/105, 74, 73, 75, DIG. 5, DIG. 7, 72, 61, 62, 104, 106, 125, 126, 127; 313/146, 151

[56] References Cited

U.S. PATENT DOCUMENTS

| | | | |
|---|---|---|---|
| 1,374,647 | 4/1921 | Gimingham | 313/151 X |
| 1,629,313 | 5/1927 | Ruttenauer | 313/151 |
| 2,564,853 | 8/1951 | McCable | 313/151 X |
| 2,891,188 | 6/1959 | Holdaway | 313/151 |
| 3,745,409 | 7/1973 | Netten | 313/151 |
| 3,746,914 | 7/1973 | Olson et al. | 315/47 |
| 4,064,416 | 12/1977 | Krense et al. | 315/60 |
| 4,135,114 | 1/1979 | Naraikiyo et al. | 315/74 |
| 4,137,483 | 1/1979 | Ochi et al. | 315/74 |
| 4,179,640 | 12/1979 | Larson et al. | 315/DIG. 5 |
| 4,277,725 | 7/1981 | Sneijers | 315/73 |

FOREIGN PATENT DOCUMENTS

| | | | |
|---|---|---|---|
| 888754 | 2/1962 | United Kingdom | 313/151 |

*Primary Examiner*—Saxfield Chatmon, Jr.
*Attorney, Agent, or Firm*—Edward J. Coleman

[57] ABSTRACT

A glow bottle starter having three lead-in wires and containing two bimetals connected together at one end and a rigid tungsten rod. The bimetals make normally closed contact with the tungsten rod in the quiescent state of the starter, and upon electrical current flow through one or both of the bimetals to cause elevation to a predetermined temperature, the bimetals are operative to separate from the tungsten rod. In a circuit including the glow-bottle starter for starting a discharge lamp, one of the bimetals and the rigid tungsten rod are connected across the output of a ballast circuit, and the tungsten rod and other bimetal are connected across the lamp. Upon initial energization of the ballast, short circuit current through the bimetal connected thereto is operative to separate the bimetals from the tungsten rod to provide an open starter circuit and a switching transient across the lamp; upon starting of the lamp, the resulting current flow through both bimetals maintains the bimetals separated from the rod.

10 Claims, 4 Drawing Figures

STARTER AND DISCHARGE LAMP STARTING CIRCUIT

BACKGROUND OF THE INVENTION

This invention relates to glow-type starter devices used for starting discharge lamps and circuits employing such starters, and more particularly, to a starter and starting circuit for use in the operation of high intensity discharge lamps containing noble gases at high pressures, e.g., in excess of 100 torr.

High intensity discharge lamps, such as high pressure sodium lamps, commonly include noble gases at pressures below 100 torr. For example, the starting gas in the standard high pressure sodium lamp is xenon at 14 torr. Lamps containing noble gases at pressures below 100 torr can be started and operated by utilizing an igniter in conjunction with a lamp ballast. The igniter electronically provides high voltage, short duration pulses which assist in initiating discharge. The lamp ballast converts the AC line voltage to the proper amplitude and impedance level for lamp operation.

It has been found that the inclusion in high pressure sodium lamps of xenon as the noble gas at pressures well in excess of 100 torr is beneficial to lamp performance. However, the igniter described above does not produce reliable starting at xenon pressures above about 100 torr. A conductor wrapped around the discharge tube and connected to one of the electrodes is described as having been utilized in assisting the starting of a lamp containing xenon at pressures up to 300 torr in U.S. Pat. No. 4,179,640. The lamp is described as having been operated from a conventional ballast and starting pulse generator.

Another arrangement for starting high pressure discharge lamps is shown in U.S. Pat. No. 4,137,483. A switching circuit contained within the lamp induces a high voltage starting pulse. The high voltage pulse operates in conjunction with a conductor wrapped around the discharge tube to initiate discharge in the lamp. The igniter and the conventional ballast are not used.

Recent developments have indicated the desirability of including xenon at pressures in excess of 300 torr in high pressure sodium lamps. However, none of the starting arrangements described above are effective to reliably start lamps having xenon pressures in excess of 300 torr. For example increases in efficiency of approximately 20% can be obtained by increasing the xenon pressure to 400–500 torr, but the voltage necessary to start these lamps is approximately double that required for lamps having a fill pressure below 100 torr. Such high amplitude starting pulses, however, undesirably increase the dielectric stresses on auxiliary equipment.

An improved starting arrangement for overcoming the aforementioned problems with respect to the starting of high intensity discharge lamps with fill gas pressures in excess of 300 torr is described in a copending application Ser. No. 139,310, filed Apr. 11, 1980 and assigned to GTE Laboratories Incorporated. A high pressure sodium lamp including a discharge tube containing xenon at pressures in excess of 300 torr is reliably started by the combination of an igniter, a conductor wrapped around the discharge tube, and a switching circuit. A conventional lamp ballast provides ac power during starting and normal operation. The conductor about the discharge tube is a starting aid which intensifies the electric field within the xenon filled tube. The igniter provides periodic pulses of 2,500–4,000 volts with a duration of about one microsecond. The switching circuit provides a high voltage pulse having an amplitude about equal to the amplitude of the periodic pulses and a duration much greater than the duration of the periodic pulses; e.g., in the order of 100 microseconds. Hence, reliable starting is achieved by increasing the pulse duration rather than the amplitude in order to minimize the dielectric stresses on auxilliary equipment.

In the aforementioned copending application Ser. No. 139,310, the specific means disclosed for implementing the switching circuit comprises, in one instance, a manual switch in series with a current limiting resistor connected across the lamp. A second switch implementation disclosed in the copending application is illustrated schematically in FIG. 1 and comprises a thermal switch 54 including a heater resistor 58 and a bimetal switch 60 connected in series. Inputs A and A′ from the lamp ballast and igniter are coupled through the heater resistor 58 to the electrodes of the discharge lamp 50. The bimetal switch 60 and a current limiting resistor 56 are coupled in series across the electrodes of the discharge lamp 50. In operation, the lamp ballast provides AC power to the points A and A′ and the igniter provides periodic pulses of high amplitude and short duration to the points A and A′ as described hereinabove. Also, the conductor 52 promotes the formation of an ionization path within the discharge lamp 50 as also described above. In a cold condition, the bimetal switch 60 is closed. Therefore, when power is applied to the points A and A′, current flows through the resistor 58, the bimetal switch 60, and the resistor 56. The heater resistor 58 is placed in close proximity to the bimetal switch so that heat generated by current passing therethrough will heat the bimetal switch 60. After a predetermined time, the heat generated by the resistor 58 causes the bimetal switch 60 to switch to the open position and the current drawn from the ballast is rapidly decreased. The rapid decrease in current drawn from the ballast causes the highly inductive output of the ballast to generate a high voltage pulse which provides sufficient energy to initiate discharge in the lamp 50. The current drawn by the discharge lamp 50 through the resistor 58 causes the resistor 58 to remain heated and the bimetal switch 60 to remain in the open position. If for some reason, the discharge lamp 50 does not start when the bimetal switch 60 opens, no current is drawn through the resistor 58, and the bimetal switch 60 cools until it recloses. Heating of the resistor 58 again occurs, causing the bimetal switch 60 to open and another high voltage starting pulse is generated. Thus, the starting process is repeated until a discharge is initiated in the lamp 50.

SUMMARY OF THE INVENTION

It is an object of the present invention to provide a new and improved starter device and an improved circuit for starting a high intensity discharge lamp.

A further object of the invention is to provide improved means for starting high intensity discharge lamps containing a noble gas or mixtures thereof at pressures in excess of 100 torr.

These and other objects, advantages and features are attained, in accordance with one aspect of the invention, by providing a glow-starter device comprising an hermetically sealed glass envelope having three lead-in wires extending therethrough and containing a gas at subatmospheric pressure. A first bimetal within the envelope is mounted on a first one of the lead-in wires, and a second bimetal is mounted on a second one of the lead-in wires, with the bimetals being electrically and mechanically connected together at one end. A rigid conductive member within the envelope is mounted on the third lead-in wire, and the bimetals are disposed to make electrical contact with the rigid conductive member at the connected-together end of the bimetals at normal room temperature and in the absence of energization of the lead-in wires. In operation, the bimetals are operative to separate from the rigid conductive member at a predetermined elevated temperature such as caused by electrical current flowing through one or both of the bimetals.

According to another aspect of the invention, a discharge lamp starting circuit is provided which comprises; a ballast circuit having an input connected to a source of AC line voltage and a power output; a glow-starter device having a first terminal connected to a first bimetal, a second terminal connected to a second bimetal, and a third terminal connected to a rigid conductive member, the bimetals being electrically connected together at one end which makes a normally closed contact with the rigid member in the quiescent state of the device; means connecting the second and third terminals of the starter device across the output of the ballast circuit; and means for connecting the first and third terminals of the starter device across the terminals of a discharge lamp. Upon initial energization of the ballast, short circuit current through the second and third terminals of the starter device is operative to flex the second bimetal for separating the bimetals from the rigid member to provide an open circuit thereat and a switching transient across the lamp. Upon starting of the lamp, the lamp current flow through the first and second terminals of the starter device is operative to maintain the bimetals separated from the rigid member.

The circuit is particularly useful where the lamp is a high pressure discharge lamp including an hermetically sealed arc tube containing a noble gas or mixtures thereof having a pressure greater than 100 torr. The preferred ballast circuit provides an ac output and includes an igniter for providing periodic high voltage pulses substantially synchronized with the peaks of the AC output of the ballast circuit. In such an arrangement, each separation of the bimetals from the rigid member in the starter device is operative to produce a high voltage pulse across the lamp which has a substantially longer duration than the periodic pulses of the igniter.

Accordingly, the starting circuit of the present invention represents an improvement over the circuit described in the aforementioned application Ser. No. 139,310 in the following respects. The present circuit eliminates the need for the current limiting resistor 56 and the heater resistor 58 of FIG. 1. Instead of the heater resistor, the bimetals of the present switching device are self heated by means of the bimetal $I^2R$ characteristic. The bimetal switch is then maintained in the open condition during lamp operation by virtue of the defined circuit arrangement with a unique three terminal glow starter device. Further yet, the starter device of the present invention permits greater control over the amplitude of the starter actuated transient pulse as this pulse amplitude can be quite closely controlled by selection of the glow-bottle gas and pressure.

BRIEF DESCRIPTION OF THE DRAWINGS

This invention will be more fully described hereinafter in conjunction with the accompanying drawings, in which.

DESCRIPTION OF PREFERRED EMBODIMENTS

Figure 1:
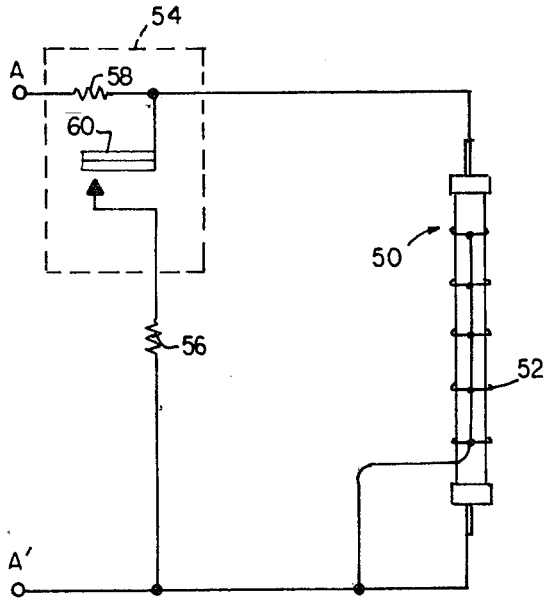
PRIOR ART FIG. 1
FIG. 1 is a circuit diagram of a prior art discharge lamp starting arrangement to which reference has been previously made.
Figure 2:
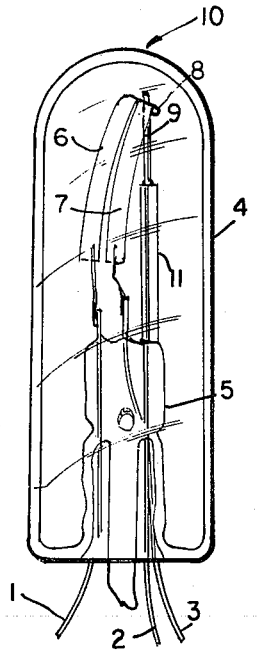
FIG. 2 is an elevational view of a glow starter device according to the invention.

Referring now to FIG. 2, a glow starter device 10 according to the invention comprises an hermetically sealed glass envelope 4 having lead-in wires 1, 2 and 3 extending therethrough. More specifically, all three lead-in wires are sealed through a reentrant stem 5 sealed at the base of the glass envelope 4.

Within the envelope, a first bimetal 6 is mounted on the lead-in wire 1, and a second bimetal 7 is mounted on the lead-in wire 2, in each case the bimetal being welded at one end to the inner end of the respective lead-in wire so as to provide a mechanical and electrical connection thereto. In the embodiment illustrated, the bimetals are shown as strips, and at the opposite end of the strips from that connected to the lead-in wires, the bimetals are electrically and mechanically connected together, such as by a segment 8 of conductive material. Attached, such as by welding, to the inner end of the lead-in wire 3 and disposed within the envelope is a rigid conductive member 9.

The flexible bimetal strips 6 and 7 are disposed within the envelope such that in the quiescent state of the device, i.e., at normal room temperature and in the absence of energization of the lead-in wires, the conductive segment 8 at the connected-together end of the bimetals 6 and 7 functions as a contact member which is resiliently urged against the rigid conductive member 9 by the bimetals to make electrical contact therewith. As will be further discussed hereinafter, the bimetals 6 and 7 are then operative to deflect away and separate from the rigid conductive member 9 at a predetermined elevated temperature, for example, 160° C., such as may be caused by the $I^2R$ characteristics of the bimetals upon electrical current flowing through one or both of the bimetals 6 and 7. Thus, a sufficient level of electrical current flowing through one or both of the bimetals 6 and 7 can cause a break in the electrical contact between segment 8 and conductive member 9.

According to one specific implementation of a glow-bottle starter device according to the invention and intended for use in starting high wattage discharge lamps, i.e., above 100 watts, the envelope 4 was formed of soda lime glass having an outside diameter of about 15 millimeters and a length of about $1\frac{3}{4}$ inches. Each of the bimetal strips 6 and 7 comprised Chase 3900 material having a thickness of 0.005 inch, a width of 0.140 inch and a length of 13/16 inch. Lead glass was used for the reentrant stem 5, and the lead-in wires 1–3 were of nickel. Conductive member 9 was a tungsten rod having a diameter of 0.045 inch and a length of 13/16 inch, and the conductive contact 8 also comprised a segment of tungsten rod. The tension of the bimetals in forcing contact segment 8 against the rod 9 was between about 40–50 grams. The hermetically sealed envelope 4 was filled with argon gas at a pressure of 2 torr. This glow-bottle embodiment intended for high wattage lamp starting also includes an insulating glass sleeve 11 disposed about the lower portion of the tungsten rod 9, as illustrated, to prevent unwanted arc over to lower portions of the bimetal strips. This high wattage lamp starter device was capable of handling a current flow of up to about 4 amperes.

According to another specific implementation of a glow-bottle starter device according to the invention and intended for use in starting low wattage discharge lamps, i.e., less than 100 watts, the envelope 4 was formed of soda lime glass having an outside diameter of 15 millimeters and a length of 40 millimeters. The stem 5 was formed of lead glass, and the lead-in wires 1–3 were formed of nickel. Bimetals 6 and 7 comprised 6650 material having a thickness of 0.004 inch, a width of 0.040 inch and a length of $\frac{5}{8}$ inch. The conductive member 9 comprised a tungsten rod having a diameter of 0.045 inch and a length of $\frac{5}{8}$ inch. In lieu of the contact segment 8, this implementation employs a pair of silver-plated copper contact buttons, one being attached to the welded together ends of the bimetal strips 6 and 7, and the other contact button being attached to the tungsten rod 9. The tension of the bimetals in forcing the contact button of the strips against the contact buttons of the rod was about 4 grams. The envelope is filled with argon gas at a pressure of about 4 torr. Further, in this embodiment intended for low wattage lamp starting, there was no necessity for a glass insulating sleeve about the tungsten rod 9, and the device was capable of handling a current flow in the order of one ampere.

Figure 3:
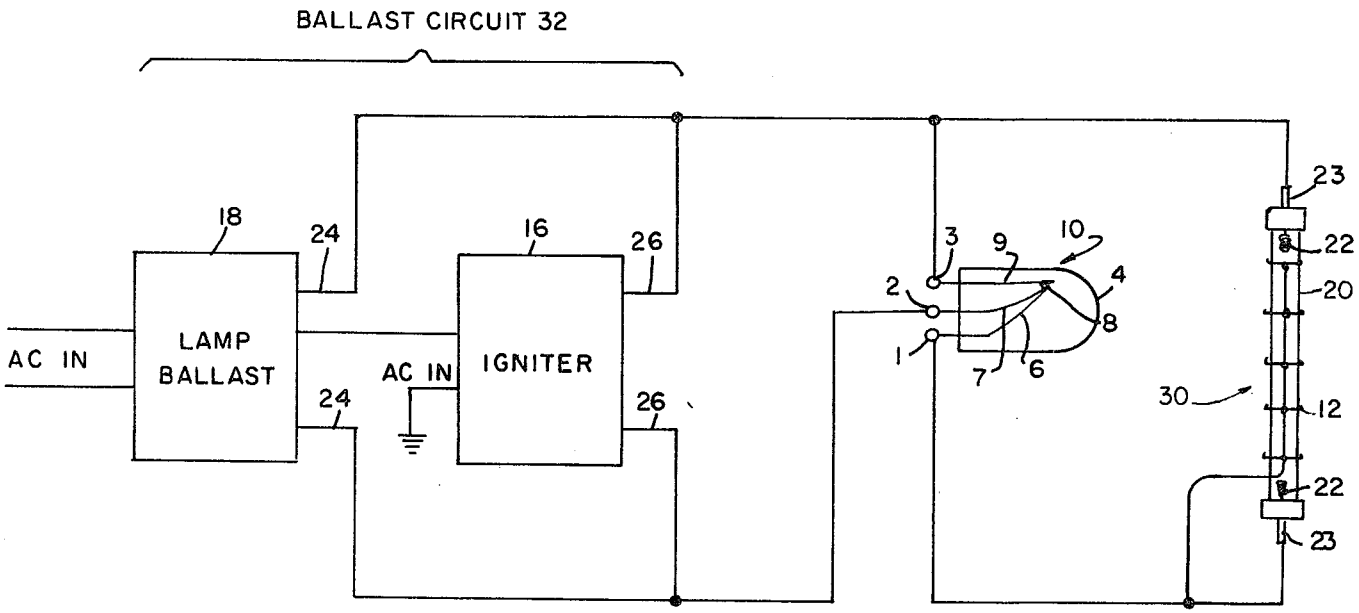
FIG. 3 is a combined block and circuit diagram of a discharge lamp starting circuit employing the starter device of FIG. 2, in accordance with the invention.

A particularly useful lamp operating circuit employing the above described three-lead glow starter device is shown in FIG. 3. The circuit includes a high intensity discharge lamp 30, the starter device 10, and a ballast circuit 32 which can comprise an igniter 16 and a conventional lead or lag type lamp ballast 18. Although not necessary to the invention, the particular embodiment illustrated is more suitable for a high pressure sodium lamp, with a fill of xenon at high pressure, of the high wattage type, i.e., above 100 watts. The lamp includes an arc tube 20, which in the case of a high pressure sodium lamp is made of alumina or other transparent ceramic material, having electrodes 22 sealed therein at opposite ends and respectively connected to lamp terminals 23 at each end. The lamp typically also includes an outer glass jacket which is not shown. A conductor 12, typically a fine wire, is wrapped about the arc tube 20 and is coupled to the electrode 22 which is connected to a reference potential such as ground. As will be made clear hereinafter, the conductor 12 functions as a starting aid for the lamp.

The lamp ballast 18 has an input connected to a source of AC line voltage, typically 115 volts, 60 Hertz, and has a power output represented by lines 24, connected across the lamp terminals 23. The igniter 16 receives an ac input from an auxillairy output of the lamp ballast 18. Outputs 26 of the igniter 16 are also coupled to the lamp terminals 23.

The above described glow starter device 10 is connected in the circuit as follows. Terminals 1 and 3, associated with bimetal 6 and the rigid conductive member 9, respectively, are connected across the terminals 23 of the discharge lamp. Terminal 2, associated with bimetal 7, and terminal 3 are connected across the output of the ballast circuit 32, i.e., across the junctions of lamp ballasts output lines 24 and igniter output lines 26.

The arc tube 20 encloses a fill material, typically including sodium or a sodium amalgam and a noble gas or mixtures of noble gases, which emit light during discharge. In particular, the inclusion in the arc tube 20 of xenon at pressures above 300 torr provides superior lamp performance. Lamp ballasts for high intensity discharge lamps are well known in the art and can be of the leading or lagging type. One example of a suitable lamp ballast is General Electric Model No. 17G3202. The lamp ballast 18 is operative to step the AC input voltage up or down depending on the magnitude of the AC input and to provide a relatively high impedance output. The igniter 16, also well known in the art, is operative to provide high amplitude, short duration pulses which assist in initiating discharge in the discharge lamp 30. Pulses appearing at outputs 26 are typically 2500 to 4000 volts in amplitude and at least one microsecond in duration. Furthermore, the pulses occur in timed relation to the AC power, typically being substantially synchronized with the peaks of the AC voltage. The specifications for the pulses produced by the igniter have been standardized by the American National Standards Institute in specification ANSI C78.1350-1976. One example of a suitable igniter is General Electric Model No. 17G9932.

Figure 4:
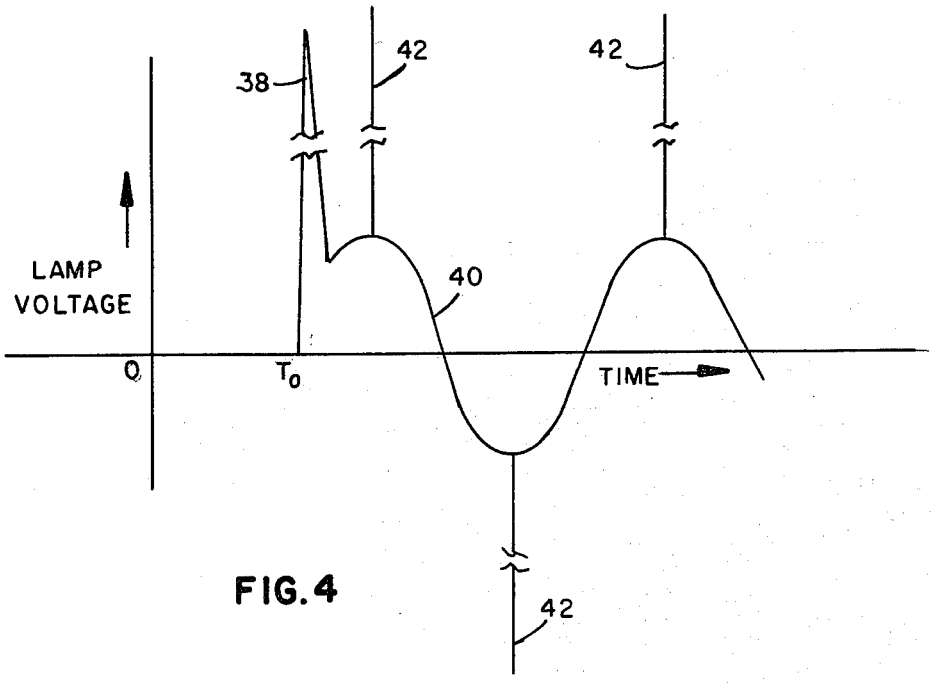
FIG. 4 is a graphic illustration of the voltage waveform applied to the electrodes of the discharge lamp shown in FIG. 3.

The combination of the conductor 12, the starter device 10, and the igniter 16 form a starting circuit which is operative to initiate discharge in the discharge lamp 30 while the lamp ballast 18 provides AC power on a continuous basis during starting and normal operation. The initiation of a discharge in the lamp 30 can be described as follows with reference to FIG. 4. Assume in the present example that the AC power is applied prior to the opening of the starter 10 contacts (segment 8 and rod 9). Thus, the lamp voltage remains approximately zero until time $T_o$ when the starter contacts separate to provide an open circuit. The opening of the starter contacts causes an inductively generated high voltage pulse 38 to be applied to the lamp. After the opening of the starter contacts, the lamp ballast 18 provides at the outputs 24 an AC voltage 40, typically 180 volts AC for a 400 watt high pressure sodium lamp. At the same time, the igniter 16 provides at its outputs 26 periodic pulses 42 having an amplitude of 2500 to 4000 volts and a duration of at least one microsecond. The periodic pulses 42 are substantially synchronized with the peaks of the AC voltage 40. Lead circuit ballasts require one pulse per half cycle of the AC voltage, as shown in FIG. 4, while lag circuit ballasts require one pulse per cycle of the AC voltage. After the discharge is established and the lamp 30 is fully warmed up, the current drawn by the lamp 30 reduces the AC output voltage 40 of the lamp ballast 18 and periodic pulses 42 are no longer provided.

As noted above, the high voltage pulse 38 is generated when the starter contacts are opened and, thus, occurs at a random time during the AC cycle of the lamp voltage 40 (not necessarily at the beginning of the cycle as illustrated in FIG. 4). Further, the illustrated pulse 38 is idealized without showing the normally occurring transient ringing. Typical lamp ballasts 18 include transformers and have highly inductive output impedances. Prior to the time $T_o$, a substantial current is drawn from the lamp ballast 18 through the short circuit provided by starter 10 via terminal 2, bimetal 7, rod 9 and terminal 3. When the starter contacts are opened, the current drawn from the lamp ballast 18 rapidly decreases and the inductance of the lamp ballast 18 generates the high voltage pulse 38. The energy provided by the high voltage pulse 38, in combination with the periodic pulses 42 and the conductor 12, is sufficient to form a discharge in the discharge lamp 30. For optimum lamp operation, the high voltage pulse 38 has an amplitude approximately equal to the amplitude of the periodic pulses 42 and a duration much greater than the duration of the periodic pulses 42. The high voltage pulse 38 is typically about 100 microseconds in duration.

The effect of the conductor 12 around the discharge tube 20 is to provide electric field distortion such that the electric field near the electrodes 22 is intensified within the discharge tube. The development of ionization in this region is thought to spread progressively along the inside surface of the arc tube 20 until a continuous path of ionization is produced between the two electrodes 22. When an ionization path is formed in which electron densities and temperatures are sufficiently elevated, the path is relatively highly conductive. At xenon pressures below 300 torr, the ionization path absorbs additional power and increases in conductivity until an arc discharge is formed and the lamp has been started. However, at xenon pressures in excess of 300 torr, the initial ionization path does not absorb additional power and arc formation does not occur in the absence of the starter device 10, or a switching device of the type described in the aforementioned copending application Ser. No. 139,310.

The voltage levels in the ballast system should not exceed the rated values, typically about 2500 volts for standard high pressure sodium lamp ballasts. The amplitude of the high voltage pulse 38 is given by L di/dt where L is the output inductance of the lamp ballast, di is the change in current when the starter contacts are opened, and dt is the time required for di to occur. Thus, the amplitude of the pulse can be controlled either by controlling the current through the closed starter contacts or by controlling the speed at which the starter contacts open. In accordance with the present invention, it has been found that the amplitude of the pulse 38 can be further controlled via glow starter device 10 by selection of the glow-bottle gas and pressure; specific examples were given hereinbefore.

It has been found that the product of the duration of the pulse and the amplitude of the pulse must be higher than a minimum value to obtain reliable lamp starting. Since it is desirable to limit the pulse 38 to approximately 2500 volts, we have found that the duration of pulse 38 must be long in relation to the duration of periodic pulse 42. It is to be understood that, while the configuration shown in FIG. 3 is most useful to start and operate high intensity lamps containing noble gases at pressures in excess of 300 torr, it can also be used to start and operate lamps containing noble gases at lower pressures.

In operation, the lamp ballast provides AC power on output lines 24 and the igniter provides periodic pulses of high amplitude and short duration on output lines 26, as described hereinabove. Also, the conductor 12 promotes the formation of an ionization path within the arc tube 20 as described hereinabove. In a cold, or quiescent condition, the bimetals 6 and 7 via segment contact 8 make a normally closed contact with the rigid member, or rod, 9. Therefore, when power is applied at the ballast circuit outputs, current flows through starter device terminal 2, bimetal 7, rod 9 and terminal 3. Upon the ballast short circuit being drawn through the bimetal 7, the $I^2R$ thereof is sufficient to flex bimetal 7 for separating both of the connected together bimetals 6 and 7 from the rod 9 to provide an open circuit thereat, whereby the current drawn from the ballast is rapidly decreased. The rapid decrease in current drawn from the ballast causes the highly inductive output of the ballast to generate a high voltage pulse which provides sufficient energy to initiate discharge in the lamp 30 as hereinabove described and shown in FIG. 4. The current drawn by the discharge lamp 30 flows through both of the connected together bimetals 6 and 7 by virtue of the illustrated circuit connection, and the resulting $I^2R$ of the bimetals is sufficient to maintain the bimetal contact segment 8 separated from rod 9, whereby the starter contacts remain in the open position. If for some reason the discharge lamp 30 does not start when the device 10 contacts are open, no current is drawn through the bimetals, whereupon the strips 6 and 7 cool and reclose the contact between segment 8 and rod 9. Heating of bimetal 7 again occurs causing the starter device contacts to open and provide another high voltage starting pulse. Thus, the starting process is repeated until a discharge is initiated in lamp 30.

Accordingly, it is clear that the glow starter 10 of the present invention is a current device as opposed to the conventional voltage type glow starters. Operation of the starter 10 is not a function of the open circuit voltage, rather the $I^2R$ deflecting function is responsive to short circuit current. The device works in circuits having low open circuit voltages where more common glow bottle starter techniques have not been able to be utilized.

Although the invention has been described with respect to a specific embodiment, it will be appreciated that modifications and changes may be made by those skilled in the art without departing from the true spirit and scope of the invention. For example, the two bimetals may be formed from a single strip which is separated longitudinally for a substantial portion of its length; accordingly, the connection at one end would then be the unseparated portion of the strip.

I claim:

1. A glow starter device comprising an hermetically sealed glass envelope having three lead-in wires extending therethrough; a gas within said envelope at subatmospheric pressure; a first bimetal within said envelope mounted on a first one of said lead-in wires; a second bimetal within said envelope mounted on an second one of said lead-in wires, said bimetals being electrically and mechanically connected together at one end; and a rigid conductive member within said envelope mounted on a third one of said lead-in wires; said bimetals being disposed to make electrical contact with said rigid conductive member at the connected-together end of the bimetals at normal room temperature and in the absence of energization of the lead-in wires, and said bimetals being operative to separate from said rigid conductive member at a predetermined elevated temperature such as caused by electrical current flowing through one or both of said bimetals.

2. The starter device of claim 1 wherein the gas fill of said envelope is argon at a pressure of about 2 torr.

3. The starter device of claim 1 wherein said rigid conductive member is a metal rod.

4. The starter device of claim 3 wherein said metal rod is tungsten.

5. The starter device of claim 4 wherein each bimetal is in the form of a flexible strip, and said strips are connected together at one end by a segment of tungsten welded across the strips, said tungsten segment being a contact member which is resiliently urged against said tungsten rod by said bimetals in the quiescent state of said device.

6. A discharge lamp starting circuit comprising, in combination:

a ballast circuit having an input connected to a source of AC line voltage and a power output;

a glow starter device having a first terminal connected to a first bimetal, a second terminal connected to a second bimetal, and a third terminal connected to a rigid conductive member, said bimetals being electrically connected together at one end which makes a normally closed contact with said rigid member in the quiescent state of said device;

means connecting the second and third terminals of said starter device across the output of said ballast circuit; and means for connecting the first and third terminals of said starter device across the terminals of a discharge lamp;

whereby upon initial energization of said ballast, short circuit current through the second and third terminals of said starter device is operative to flex said second bimetal for separating said bimetals from said rigid member to provide an open circuit thereat and a switching transient across the lamp, and upon starting of said lamp, the lamp current flow through the first and second terminals of said starter device is operative to maintain said bimetals separated from said rigid member.

7. The circuit of claim 6 wherein said lamp is a high pressure discharge lamp including an hermetically sealed arc tube having electrodes sealed therein and connected to respective terminals of the lamp, said lamp containing a noble gas or mixtures thereof having a pressure of greater than 100 torr.

8. The circuit of claim 6 wherein said ballast circuit provides an AC output and includes an igniter for providing periodic high voltage pulses substantially synchronized with the peaks of the AC output of the ballast circuit, and each separation of said bimetals from said rigid member in said starter device is operative to produce a high voltage pulse across said lamp which has a substantially longer duration than the periodic pulses of said igniter.

9. The circuit of claim 8 wherein said starter device further includes an hermetically sealed envelope within which said bimetals and said rigid member are disposed, and said envelope is filled with a gas at subatmospheric pressure, the amplitude of said pulse produced by said starter being controlled by the selection of said gas and the pressure thereof to be about the same as the amplitude of the periodic pulses.

10. The circuit of claim 7 wherein said lamp has a starting aid comprising a conductor coupled to one of said electrodes and located in close proximity to the outer surface of said arc tube.

* * * * *